US012054878B2

(12) United States Patent
Mckenzie

(10) Patent No.: US 12,054,878 B2
(45) Date of Patent: Aug. 6, 2024

(54) UNDERGARMENT LAUNDERING BAG

(71) Applicant: BCB Boobsbags LLC, Dothan, AL (US)

(72) Inventor: Brittney Mckenzie, Dothan, AL (US)

(73) Assignee: BCB Boobsbags LLC, Dothan, AL (US)

( * ) Notice: Subject to any disclaimer, the term of this patent is extended or adjusted under 35 U.S.C. 154(b) by 134 days.

(21) Appl. No.: 17/735,588

(22) Filed: May 3, 2022

(65) Prior Publication Data

US 2022/0349115 A1 Nov. 3, 2022

Related U.S. Application Data

(60) Provisional application No. 63/183,354, filed on May 3, 2021.

(51) Int. Cl.
*D06F 95/00* (2006.01)
*A41F 1/00* (2006.01)

(52) U.S. Cl.
CPC ..... *D06F 95/006* (2013.01); *A41F 1/006* (2013.01)

(58) Field of Classification Search
CPC ..... A41F 1/006; D06F 95/006
USPC ..... 383/42
See application file for complete search history.

(56) References Cited

U.S. PATENT DOCUMENTS 2,015,119 A * 9/1935 McEwen ..... B65D 29/00 383/92
3,036,616 A * 5/1962 Allen ..... D06F 95/006 383/38
5,238,305 A * 8/1993 Feller ..... A47K 3/281 383/117
5,320,429 A * 6/1994 Toyosawa ..... D06F 95/008 383/117
5,503,476 A * 4/1996 Hamdan ..... D06F 95/002 383/86.2
5,803,605 A * 9/1998 Masi ..... D06F 95/006 383/41
6,536,952 B1 * 3/2003 Hsieh ..... D06F 95/006 383/117
10,136,712 B2 * 11/2018 Taylor-Phillips ..... A45C 5/005
10,843,869 B1 * 11/2020 Rivera ..... B65F 1/1452
10,920,366 B1 * 2/2021 Mulholland ..... D06F 95/008
10,927,494 B1 * 2/2021 Sayarat ..... A47G 25/14
11,006,716 B2 * 5/2021 Tayne ..... A45C 13/26
2004/0264815 A1 * 12/2004 Gibeau ..... D06F 95/006 383/117
2009/0185764 A1 * 7/2009 Hsieh ..... D06F 95/006 383/117
2010/0120586 A1 * 5/2010 Ruschell ..... A63B 71/0054 482/148
2011/0192740 A1 * 8/2011 Berglund ..... B65D 33/12 206/287
2013/0075288 A1 * 3/2013 Bielski ..... D06F 95/006 53/473
2014/0109321 A1 * 4/2014 Allende ..... D06F 95/008 223/84

(Continued)

*Primary Examiner* — Peter N Helvey
(74) *Attorney, Agent, or Firm* — Greenberg Traurig, LLP

(57) ABSTRACT

An undergarment laundering bag includes an enclosure formed from water-permeable material, the enclosure defining an interior surrounded by an inner surface of the enclosure, and disposed on the inner surface, one or more of a hook for coupling with an eye of a bra, or an eye for coupling with a hook of a bra.

20 Claims, 8 Drawing Sheets

(56) References Cited

U.S. PATENT DOCUMENTS

| | | | | |
|---|---|---|---|---|
| 2017/0215616 | A1* | 8/2017 | Cunningham | D06F 95/008 |
| 2018/0312329 | A1* | 11/2018 | Siegel | A45C 3/001 |
| 2019/0169790 | A1* | 6/2019 | Bellamy | D06F 95/006 |
| 2019/0382947 | A1* | 12/2019 | Doescher | B65D 33/28 |
| 2021/0395944 | A1* | 12/2021 | Harris | D06F 95/006 |
| 2023/0303291 | A1* | 9/2023 | Oestreicher | B65D 85/36 383/42 |

* cited by examiner

UNDERGARMENT LAUNDERING BAG

CROSS-REFERENCE TO RELATED APPLICATION

This application claims the benefit of priority to U.S. application No. 63/183,354, filed May 3, 2021, which application is hereby incorporated by reference in its entirety.

FIELD OF THE DISCLOSURE

The present disclosure generally relates to a bag for laundering undergarments.

DETAILED DESCRIPTION

Figure 1:
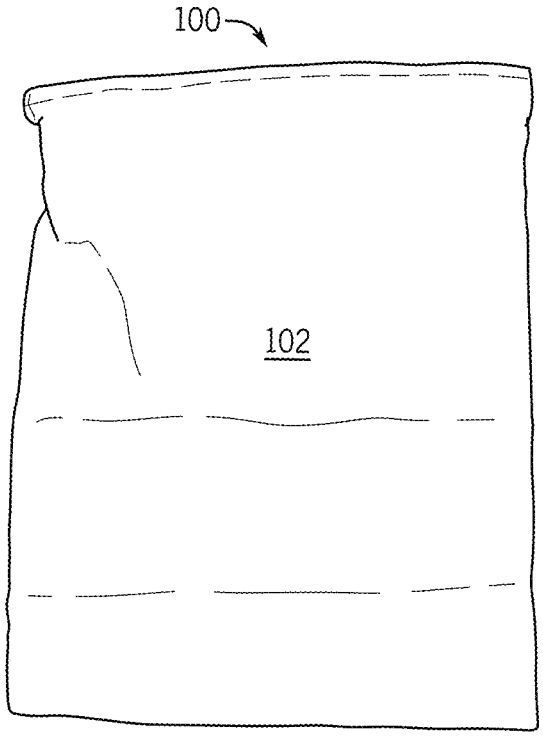
FIG. 1 is a perspective view of an example undergarment laundering bag.
Figure 2:
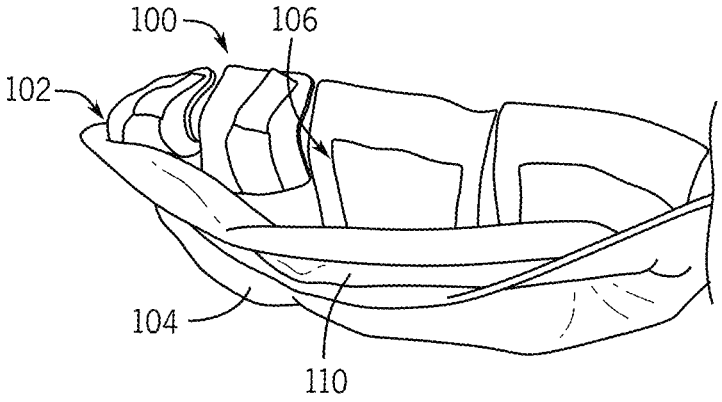
FIG. 2 is a perspective view of a plurality of bras disposed within an open undergarment laundering bag.
Figure 3:
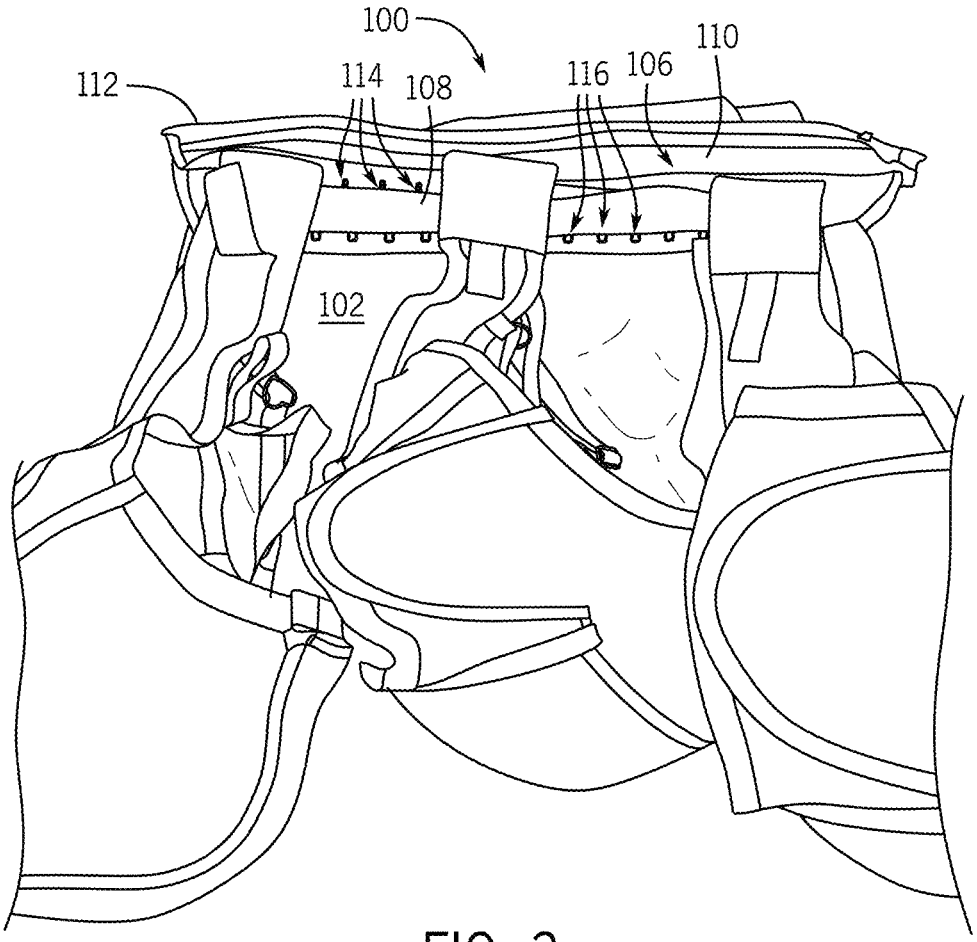
FIG. 3 is a front view of an example undergarment laundering bag, with a plurality of bras coupled to the bag and disposed outside of the bag.
Figure 4:
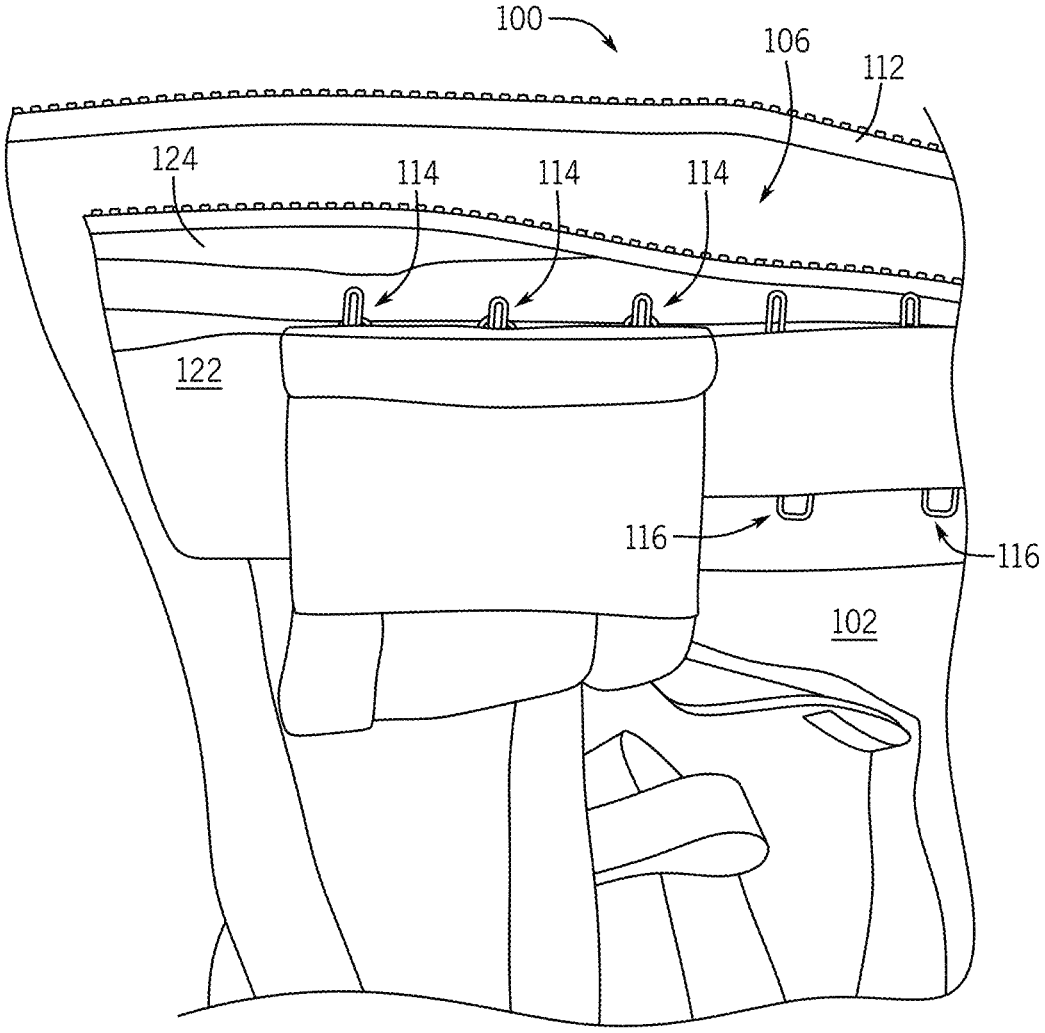
FIG. 4 is an enlarged view of a bra's eyes coupled with hooks of an example undergarment laundering bag.
Figure 5:
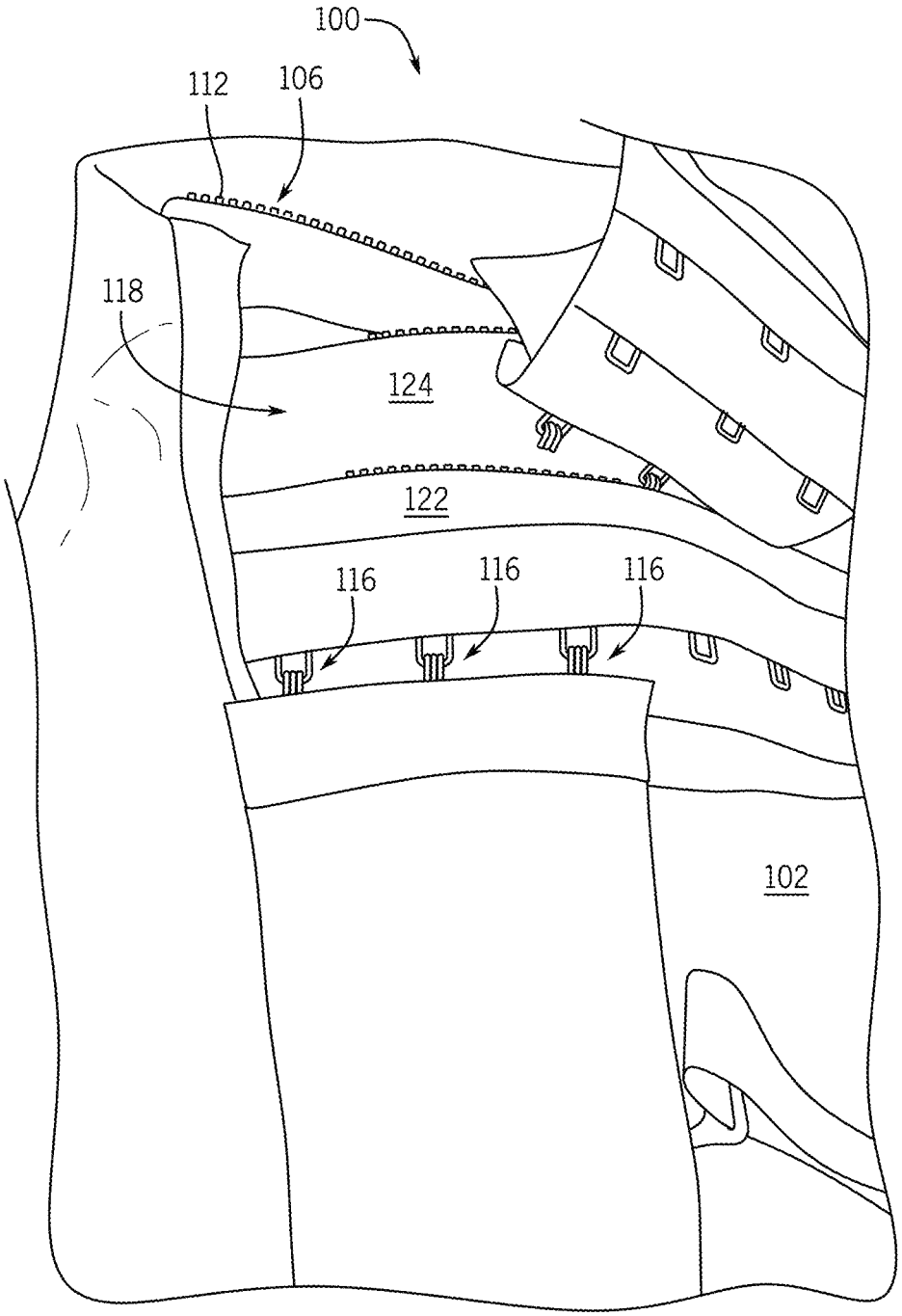
FIG. 5 is an enlarged view of a bra's hooks coupled with eyes of an example undergarment laundering bag.
Figure 6:
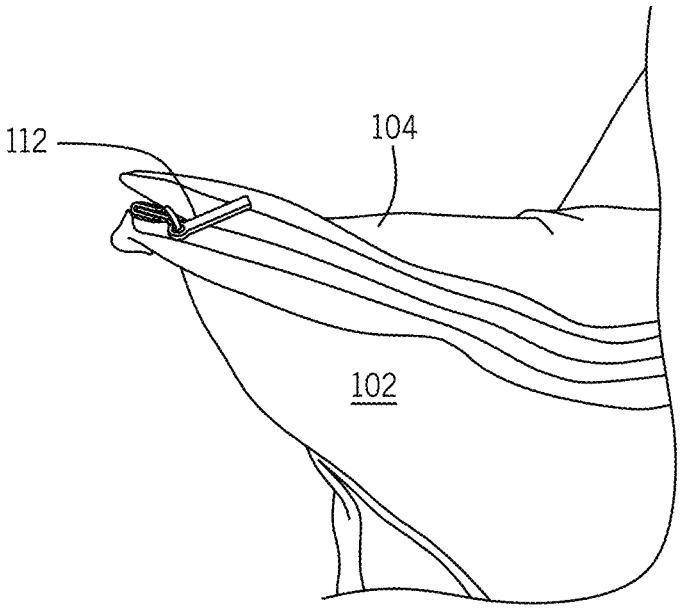
FIG. 6 is an enlarged view of an example primary zipper of the undergarment laundering bag.
Figure 7:
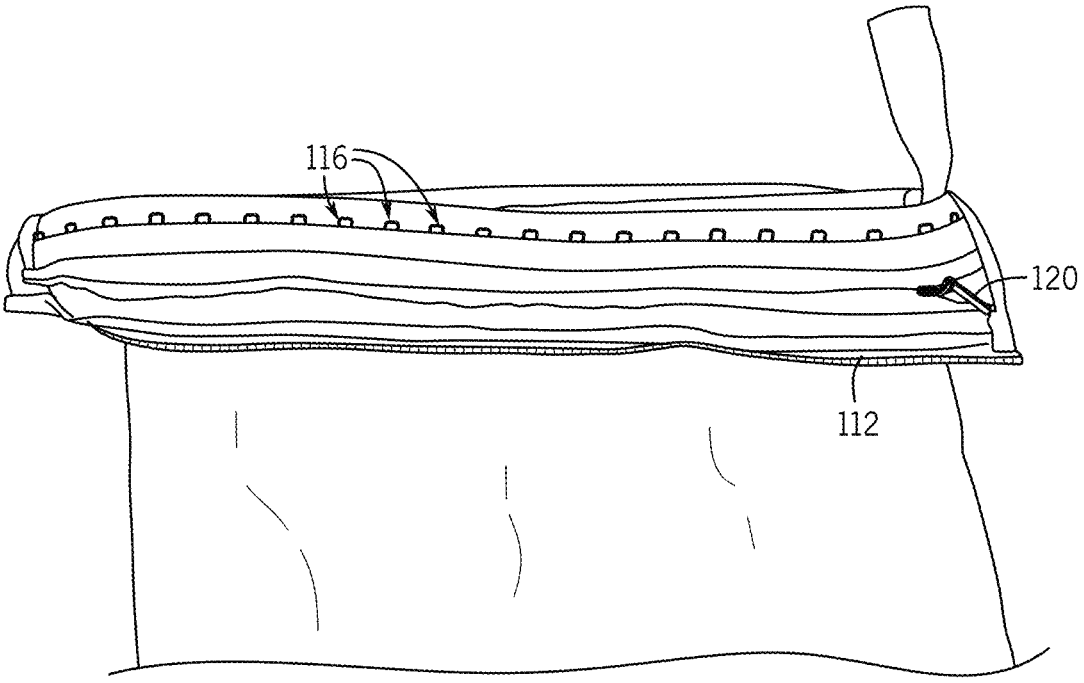
FIG. 7 is an enlarged view of a portion of the undergarment laundering bag.
Figure 8:
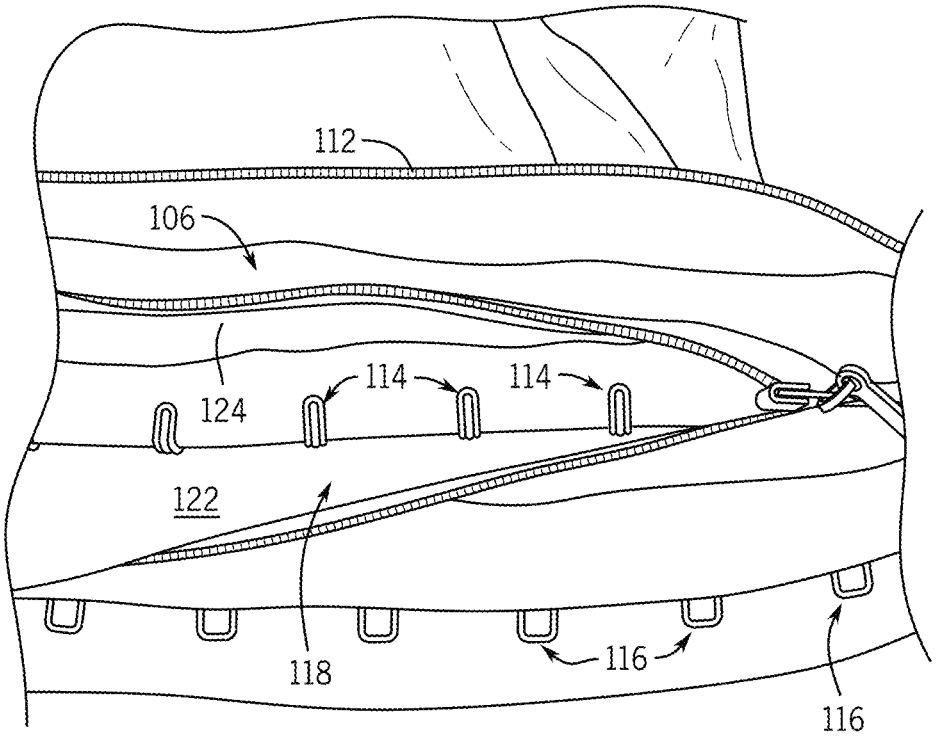
FIG. 8 is an enlarged view of a portion of the undergarment laundering bag to better illustrate an example secondary enclosure.

An undergarment laundering bag according to the present disclosure may be used to launder undergarments, such as bras. An undergarment laundering bag according to the present disclosure may find particular use with undergarments having hook and/or eye closures. An undergarment laundering bag according to the present disclosure may hold and protect women's delicate and intimate undergarments while they are washed and prevent those garments for becoming tangled or damaged in the washing machine.

Known garment laundering bags do not adequately protect women's delicate undergarments. For example, a simple mesh bag with a nylon zipper, a zippered cylinder mesh laundry bag (e.g., available from WOOLITE™ or WHITMORE™), or a honeycomb laundry bag all lack any structure for securing an undergarment, such as a bra, in place within the bag during a wash cycle. As a result, bras may become tangled or bunched within the bag, which could lead to damage to the garment, difficulty removing the garment from the bag, and/or inconsistent or incomplete washing of the garment. An undergarment bag according to the present disclosure improves on these known devices.

Referring to the drawings, wherein like reference numerals refer to the same or similar features in the various views, FIGS. 1-8 illustrate an undergarment bag 100 having a first panel 102 and a second panel 104 that collectively define an enclosure of the undergarment bag 100. The first and second panels 102, 104 also collectively define an interior 106 in which one or more undergarments, such as bras, may be placed and secured for laundering. The interior 106 may include and be surrounded by a first inner surface 108 on the first panel 102 and a second interior surface 110 on the second panel 104. Each panel 102, 104 may have a width of between approximately 12 inches and 24 inches and a height of approximately between 12 inches and 24 inches, in some embodiments.

The first and second panels 102, 104 may be generally rectangular and may be stitched together or otherwise permanently fastened to each other on a plurality of sides or edges (e.g., three edges). A fourth edge or side of the panels 102, 104 may include an opening 107 that may be fastenable. For example a primary zipper 112 or other fastener may be provided at the fourth edge for closing the interior so as to secure one or more undergarments within the interior. The primary zipper 112 may be or may include an invisible concealed nylon closed end zipper, in some embodiments. The opening 107, and consequently the primary zipper 112, may have a length of 14 inches, 16 inches, or other appropriate dimension.

The panels 102, 104 may be made from or may include a water-permeable material, such as a mesh material, in some embodiments. For example, the panels 102, 104 may be made from or may include a polyester taffeta lining fabric. One or both panels may have a width of 54 inches, or other appropriate dimension, and a material weight of 4.0 ounces per yard, or other appropriate weight.

One or more inner surfaces 108, 110 of the bag 100 may include one or more hooks 114 for coupling with respective eyes of an undergarment, such as a bra, and/or one or more eyes 116 for coupling with respective hooks of an undergarment, such as a bra. In some embodiments, an inner surface 108, 110 may include a plurality of eyes 116 and/or a plurality of hooks 114. For example, in some embodiments, a sufficient quantity of hooks 114 and/or a sufficient quantity of eyes 116 may be provided for coupling two or more undergarments (e.g., four or more hooks 114 or eyes 116, six or more hooks 114 or eyes 116, etc.).

The hooks 114 and/or eyes 116 may be uniformly spaced on an inner surface 108, 110 consistent with the expected spacing of the hooks and eyes of an undergarment. For example, in some embodiments, adjacent hooks 114 and/or eyes 116 may be spaced at ¾ of an inch from each other. In some embodiments, a plurality of hooks 114 and/or eyes 116 may be provided on a tape that is sewn to or otherwise fastened to the inside of a panel 102, 104. The hooks 114 and/or eyes 116 may be made from or may include nylon, another polyamide, and/or any other appropriate material.

The hooks 114 and/or eyes 116 may be provided in a line adjacent to the opening of the enclosure, in some embodiments. Accordingly, the hooks 114 and/or eyes 116 may be spaced approximately 12-24 inches from the bottom of the enclosure, in some embodiments, to permit sufficient space for a coupled undergarment to hang from the hooks 114 or eyes 116 within the enclosure. In some embodiments, two or more lines, one above another, of hooks 114 may be provided. In some embodiments, two or more lines, one above another, of eyes 116 may be provided.

The hooks 114 may be provided in a secondary enclosure 118 that is selectably closeable with a secondary zipper 120. The secondary enclosure 118 may be formed by the first panel 102 and flaps 122, 124 coupled to the inner surface 108, which flaps 122, 124 may be joined and enclosed using the secondary zipper 120. Providing the hooks 114 in a closeable secondary enclosure may enable the bag 100 to be used to launder garments (e.g., garments that do not include hooks or eyes) within the bag 100 without using the hooks 114 and eliminating the risk of those garments catching on the hooks 114 during laundering.

Figure 9:
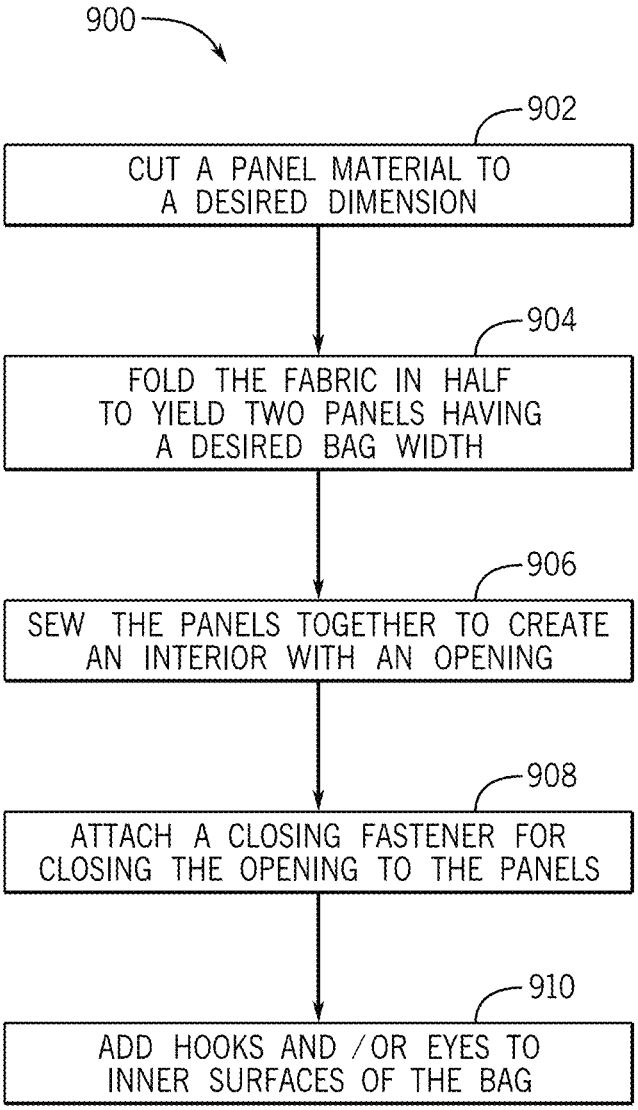
FIG. 9 is a flow chart illustrating an example method of manufacturing an undergarment bag.

FIG. 9 is a flow chart illustrating an example method 900 of manufacturing an undergarment bag. The method 900 may include, at block 902, cutting a panel material to a desired dimension. For example, block 902 may include cutting a polyester taffeta fabric with a 16-inch height to a width of 38 inches. The method 900 may further include, at block 904, folding the fabric in half to yield two panels having a desired bag width. The method 900 may further include, at block 906, sewing the panels together with a desired amount of allowance (e.g., ⅜ of an inch of allowance). After sewing, the bag may have a defined interior with a top opening.

The method 900 may further include, at block 908, attaching a first closing fastener for closing the opening to the panels. For example, a first zipper portion may be sewn to a first inner surface (e.g., an inner surface of a first panel). The first zipper portion (e.g., half) may be, for example, 16 inches or another appropriate length. A second zipper portion (e.g., half) may be sewn to a second inner surface that opposes the first inner surface (e.g., an inner surface of a second panel) and which mates with the first zipper portion to form the first zipper.

The method 900 may further include, at block 910, adding one or more hooks and/or one or more eyes to inner surfaces of the undergarment bag. For example, block 910 may include cutting a nylon hook tape to a 14 inch length, cutting a nylon eye tape to a 14 inch length, sewing the hook tape and eye tape together, and sewing the hook tape and eye tape to an inner surface of the bag, such that a plurality of hooks and a plurality of eyes are provided on the same inner surface, one above the other. In some embodiments, the hooks and eyes may be provided on opposed inner surfaces of the bag.

In some embodiments, block 910 may include attaching one or more flaps to an inner surface of one of the panels to create a secondary enclosure within the primary enclosure of the bag. In such embodiments, block 910 may further include coupling a second closing fastener, such as a second zipper, to the flaps to enable closing the second enclosure. In some embodiments, block 910 may further include adding the one or more hooks and/or the one or more eyes within the secondary enclosure.

Figure 10:
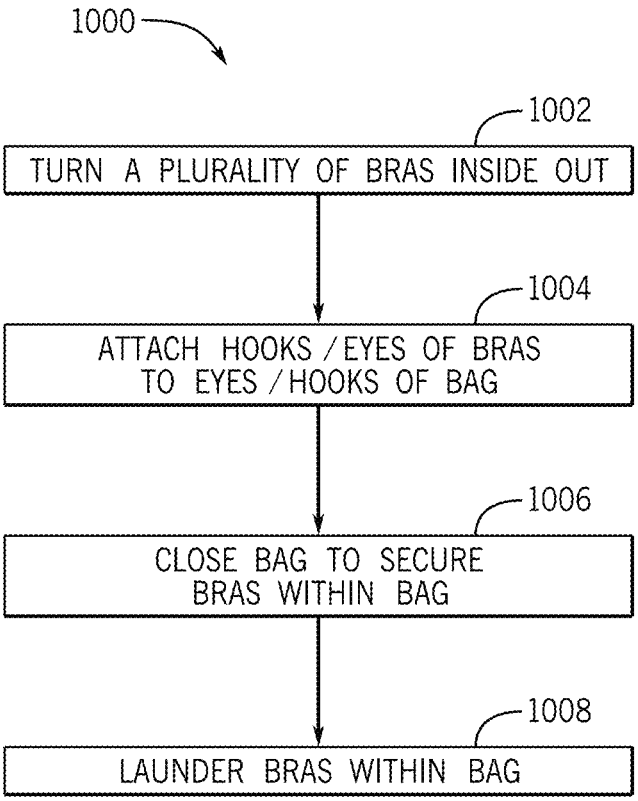
FIG. 10 is a flow chart illustrating an example method of laundering one or more undergarments using an undergarment bag.

FIG. 10 is a flow chart illustrating an example method 1000 of washing one or more undergarments using an undergarment bag according to the present disclosure. The method 1000 will be described with reference to laundering a plurality of bras, but the method may find use with other undergarments having hooks and/or eyes.

The method 1000 may include, at block 1002, turning a plurality of bras inside out and, at block 1004, attaching the plurality of bras to hooks and/or eyes inside the undergarment bag. For example, block 1004 may include, for each of the plurality of bras, coupling a plurality of eyes of the bra to a corresponding plurality of adjacent hooks on the inner surface of the bag, or coupling a plurality of hooks of the bra to a corresponding plurality of adjacent eyes on the inner surface of the bag. Multiple bras may be coupled to separate and adjacent sets of hooks and/or eyes within the bag. In some embodiments, block 1004 may include coupling the hooks of a bra to eyes of the bag, and coupling eyes of the same bra to hooks of the bag.

The method 1000 may further include, at block 1006, closing the bag to secure the bras within the bag. For example, block 1006 may include closing a zipper of the bag.

The method 1000 may further include, at block 1008, laundering the bag with the bras secured within the bag so as to launder the bras. Block 1008 may include, for example, washing on a cold water cycle with no bleach and mild or gentle detergent and tumble drying on a low setting or hanging dry.

In a first aspect of the present disclosure, an undergarment laundering bag is provided that includes an enclosure formed from water-permeable material, the enclosure defining an interior surrounded by an inner surface of the enclosure, and disposed on the inner surface, one or more of a hook for coupling with an eye of a bra or an eye for coupling with a hook of a bra.

In an embodiment of the first aspect, the undergarment laundering bag includes a plurality of hooks disposed on the inner surface. In a further embodiment of the first aspect, the plurality of hooks are provided in a line adjacent to an opening of the enclosure. In a further embodiment of the first aspect, the plurality of hooks are spaced by ¾ inches from each other.

In an embodiment of the first aspect, the undergarment laundering bag includes a plurality of eyes disposed on the inner surface. In a further embodiment of the first aspect, the plurality of eyes are provided in a line adjacent to an opening of the enclosure. In a further embodiment of the first aspect, the plurality of eyes are spaced by ¾ inches from each other.

In an embodiment of the first aspect, the undergarment laundering bag includes a hook for coupling with an eye of a bra, the hook disposed on the inner surface and an eye for coupling with a hook of a bra, the eye disposed on the inner surface. In a further embodiment of the first aspect, the undergarment laundering bag includes a plurality of hooks disposed on the inner surface and a plurality of eyes disposed on the inner surface.

In an embodiment of the first aspect, the enclosure is a primary enclosure, the undergarment laundering bag further including a selectably closeable secondary enclosure disposed within the primary enclosure, wherein the one or more of a hook for coupling with an eye of a bra or an eye for coupling with a hook of a bra is disposed within the secondary enclosure. In a further embodiment of the first aspect, the undergarment laundering bag further includes a zipper for closing the secondary enclosure, the zipper concealed within the primary enclosure when the primary enclosure is closed.

In an embodiment of the first aspect, the undergarment laundering bag includes a zipper for closing an opening of the enclosure to secure one or more bras within the enclosure.

In an embodiment of the first aspect, the water-permeable material comprises nylon.

In an embodiment of the first aspect, the water-permeable material comprises taffeta fabric.

In an embodiment of the first aspect, the enclosure comprises a first panel of the material and a second panel of the material, the first panel joined to the second panel to form the enclosure with an upper opening.

In a second aspect of the present disclosure, a method of using an undergarment laundering back is provided. The method includes providing an undergarment laundering bag that includes an enclosure formed from water-permeable material, the enclosure defining an interior surrounded by an inner surface of the enclosure, and disposed on the inner surface, one or more of a hook for coupling with an eye of a bra, or an eye for coupling with a hook of a bra. The method further includes coupling a hook of the bra to the eye on the inner surface or coupling an eye of the bra to the hook on the inner surface, placing the bra within the enclosure, and laundering the undergarment laundering bag while the bra is inside the undergarment laundering bag.

In an embodiment of the second aspect, the method further includes, after placing the bra within the enclosure, closing a zipper of the undergarment laundering bag to secure the bra within the enclosure.

In an embodiment of the second aspect, the undergarment laundering bag comprises a plurality of hooks disposed on the inner surface or a plurality of eyes disposed on the inner surface, the method further including coupling a plurality of hooks of one or more bras to respective ones of the eyes on the inner surface or coupling a plurality of eyes of one or more bras to respective ones of the plurality of hooks on the inner surface, placing the one or more bras within the enclosure, and laundering the undergarment laundering bag while the one or more bras are inside the undergarment laundering bag. In a further embodiment of the second aspect, the one or more hooks on the inner surface comprise a plurality of hooks or the one or more eyes on the inner surface comprise a plurality of eyes, and the one or more bras comprise a plurality of bras. In a further embodiment of the second aspect, the one or more bras are coupled adjacent to one another to the plurality of hooks on the inner surface or to the plurality of eyes on the inner surface.

While this disclosure has described certain embodiments, it will be understood that the claims are not intended to be limited to these embodiments except as explicitly recited in the claims. On the contrary, the instant disclosure is intended to cover alternatives, modifications and equivalents, which may be included within the spirit and scope of the disclosure. Furthermore, in the detailed description of the present disclosure, numerous specific details are set forth in order to provide a thorough understanding of the disclosed embodiments. However, it will be obvious to one of ordinary skill in the art that systems and methods consistent with this disclosure may be practiced without these specific details. In other instances, well known methods, procedures, components, and circuits have not been described in detail as not to unnecessarily obscure various aspects of the present disclosure.

What is claimed is:

1. An undergarment laundering bag comprising:

a selectively-closeable primary enclosure formed from water-permeable material, the enclosure defining an interior;

a selectively-closeable secondary enclosure disposed within and permanently affixed to the primary enclosure, the secondary enclosure having an inner surface; and disposed on the inner surface, one or more of:

a hook for coupling with an eye of a bra; or an eye for coupling with a hook of a bra.

2. The undergarment laundering bag of claim 1, further comprising a plurality of hooks disposed on the inner surface.

3. The undergarment laundering bag of claim 2, wherein the plurality of hooks are provided in a line adjacent to an opening of the enclosure.

4. The undergarment laundering bag of claim 3, wherein the plurality of hooks are spaced by ¾ inches from each other.

5. The undergarment laundering bag of claim 1, further comprising a plurality of eyes disposed on the inner surface.

6. The undergarment laundering bag of claim 5, wherein the plurality of eyes are provided in a line adjacent to an opening of the enclosure.

7. The undergarment laundering bag of claim 6, wherein the plurality of eyes are spaced by ¾ inches from each other.

8. The undergarment laundering bag of claim 1, comprising:

a hook for coupling with an eye of a bra, the hook disposed on the inner surface; and an eye for coupling with a hook of a bra, the eye disposed on the inner surface.

9. The undergarment laundering bag of claim 8, further comprising:

a plurality of hooks disposed on the inner surface; and a plurality of eyes disposed on the inner surface.

10. The undergarment laundering bag of claim 1, further comprising a zipper for closing the secondary enclosure, the zipper concealed within the primary enclosure when the primary enclosure is closed.

11. The undergarment laundering bag of claim 10, further comprising a zipper for closing an opening of the primary enclosure to secure one or more bras within the enclosure.

12. The undergarment laundering bag of claim 1, wherein the water-permeable material comprises nylon.

13. The undergarment laundering bag of claim 1, wherein the water-permeable material comprises taffeta fabric.

14. The undergarment laundering bag of claim 1, wherein the primary enclosure comprises a first panel of the material and a second panel of the material, the first panel joined to the second panel to form the enclosure with an upper opening.

15. A method of using an undergarment laundering bag back, the method comprising:

providing an undergarment laundering bag comprising:

a selectively closeable primary enclosure formed from water-permeable material, the enclosure defining an interior;

a selectively-closeable secondary enclosure disposed within and permanently affixed to the primary enclosure, the secondary enclosure having an inner surface; and disposed on the inner surface, one or more of:

a hook for coupling with an eye of a bra; or an eye for coupling with a hook of a bra;

coupling a hook of the bra to the eye on the inner surface or coupling an eye of the bra to the hook on the inner surface;

placing the bra within the secondary enclosure; and laundering the undergarment laundering bag while the bra is inside the undergarment laundering bag.

16. The method of claim 15, further comprising:

after placing the bra within the secondary enclosure, closing a zipper of the undergarment laundering bag to secure the bra within the enclosure.

17. The method of claim 16, wherein the undergarment laundering bag comprises a plurality of hooks disposed on the inner surface or a plurality of eyes disposed on the inner surface, the method further comprising:

coupling a plurality of hooks of one or more bras to respective ones of the eyes on the inner surface or coupling a plurality of eyes of one or more bras to respective ones of the plurality of hooks on the inner surface;

placing the one or more bras within the secondary enclosure; and laundering the undergarment laundering bag while the one or more bras are inside the undergarment laundering bag.

18. The method of claim 17, wherein:

the one or more hooks on the inner surface comprise a plurality of hooks or the one or more eyes on the inner surface comprise a plurality of eyes; and the one or more bras comprise a plurality of bras.

19. The method of claim 18, wherein the one or more bras are coupled adjacent to one another to the plurality of hooks on the inner surface or to the plurality of eyes on the inner surface.

20. The undergarment laundering bag of claim 1, wherein the primary enclosure and the secondary enclosure are independently closeable.

* * * * *